US009935385B2

(12) United States Patent
Phillips et al.

(10) Patent No.: US 9,935,385 B2
(45) Date of Patent: Apr. 3, 2018

(54) RECEPTACLE CONNECTOR WITH CONTACT ASSEMBLY

(71) Applicant: TYCO ELECTRONICS CORPORATION, Berwyn, PA (US)

(72) Inventors: Michael John Phillips, Camp Hill, PA (US); Randall Robert Henry, Harrisburg, PA (US); Michael Eugene Shirk, Grantville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/230,882

(22) Filed: Aug. 8, 2016

(65) Prior Publication Data

US 2018/0040971 A1 Feb. 8, 2018

(51) Int. Cl.

| | |
|---|---|
| ***H01R 12/71*** | (2011.01) |
| ***H01R 13/26*** | (2006.01) |
| ***H01R 13/506*** | (2006.01) |
| ***H01R 13/516*** | (2006.01) |
| *H01R 12/73* | (2011.01) |
| *H01R 12/72* | (2011.01) |

(52) U.S. Cl.

CPC ..... *H01R 12/716* (2013.01); *H01R 13/26* (2013.01); *H01R 13/506* (2013.01); *H01R 13/516* (2013.01); *H01R 12/721* (2013.01); *H01R 12/73* (2013.01); *H01R 12/737* (2013.01)

(58) Field of Classification Search

CPC ..... H01R 12/73; H01R 12/737; H01R 12/721
USPC ..... 439/629, 637
See application file for complete search history.

(56) References Cited

U.S. PATENT DOCUMENTS

| | | | | |
|---|---|---|---|---|
| 7,114,963 | B2 * | 10/2006 | Shuey | H01R 23/6873 439/660 |
| 7,229,319 | B2 * | 6/2007 | Dahms | H01R 12/716 439/108 |
| 7,410,392 | B2 * | 8/2008 | Szczesny | H01R 12/585 439/108 |
| 7,824,224 | B2 * | 11/2010 | Su | H01R 23/688 439/607.05 |
| 8,282,421 | B2 * | 10/2012 | Lee | H01R 13/514 439/629 |
| 8,550,855 | B2 * | 10/2013 | Zhang | H01R 13/405 439/636 |
| 9,166,317 | B2 * | 10/2015 | Briant | H01R 12/737 |
| 9,373,920 | B2 * | 6/2016 | Miki | H01R 24/66 |
| 2007/0123109 | A1 * | 5/2007 | Gillespie | H01R 12/721 439/634 |

(Continued)

*Primary Examiner* — Tho D Ta
*Assistant Examiner* — Marcus Harcum

(57) ABSTRACT

A receptacle connector includes a contact assembly having a dielectric carrier holding contacts, which may be overmolded by the dielectric carrier. The receptacle connector includes a housing holding the contact assembly having a mating end mated with a plug connector and a mounting end mounted to the circuit board. The housing has first and second side walls and first and second end walls. The housing has a card slot open at the top for receiving the plug connector and a contact assembly cavity open at the bottom for receiving the contact assembly. The housing may have positioning ribs extending from the first and second side walls to position the contact assembly within the cavity and/or strengthening ribs extending across the cavity to connect the side walls at a location remote from the end walls.

20 Claims, 5 Drawing Sheets

(56) References Cited

U.S. PATENT DOCUMENTS

| | | | | |
|---|---|---|---|---|
| 2012/0202363 | A1* | 8/2012 | McNamara | H01R 13/6461 439/74 |
| 2012/0225588 | A1* | 9/2012 | Westman | H01R 12/721 439/636 |
| 2012/0252232 | A1* | 10/2012 | Buck | H01R 12/585 439/55 |
| 2013/0115814 | A1* | 5/2013 | Briant | H01R 12/716 439/607.08 |
| 2014/0302720 | A1* | 10/2014 | Jiang | H01R 13/405 439/630 |

* cited by examiner

RECEPTACLE CONNECTOR WITH CONTACT ASSEMBLY

BACKGROUND OF THE INVENTION

The subject matter herein relates generally to receptacle connectors having contact assemblies.

High speed electrical connectors typically transmit and receive data signals across a mating interface. For example, some known receptacle connectors are mounted to a circuit board and include a card slot that receives a card edge of a plug connector at the mating interface. The receptacle connectors have contacts including deflectable spring beams at the mating interface that are spring loaded against the plug connector when the plug connector is loaded into the slot. The contacts are typically loaded or stitched into the housing. However, receptacle connectors having contacts on tight centerline spacing have problems with manufacturing the housing because the walls between channels holding the contacts are relatively thin, and there are problems holding the contacts in the channels because the thin walls have insufficient material to retain the contacts. Some known receptacle connectors utilize contact assemblies that are loaded into the housing. However, such receptacle connectors have problems retaining the contact assemblies in the housing. For example, press-fit features used to hold the contact assembly become stressed under the mating load. Additionally, the housing tends to bow and open up, causing insufficient retaining forces to hold the contact assembly in the housing. Additionally, the bowing changes the shape of the housing causing the positioning of the housing and the contact beams to be misaligned from each other, from the plug connector and/or from the circuit board.

A need remains for a receptacle connector that retains and positions a contact assembly for mating with a plug connector and mounting to a circuit board.

BRIEF DESCRIPTION OF THE INVENTION

In an embodiment, a receptacle connector configured to mate with a plug connector is provided including a contact assembly having a first contact sub-assembly and a second contact sub-assembly coupled to the first contact sub-assembly. The first and second contact sub-assemblies have corresponding first and second dielectric carriers. The first and second contact sub-assemblies have contacts held by the first and second dielectric carriers, respectively. The contacts are arranged in first and second contacts arrays aligned in corresponding first and second rows. The contacts have mating ends configured for electrical connection with the plug connector, terminating ends configured for electrical connection with a circuit board, and intermediate sections between the mating ends and the terminating ends being overmolded by an overmolded body forming the corresponding first and second dielectric carriers. The receptacle connector includes a housing holding the contact assembly having a mating end at a top of the housing configured to mate with the plug connector and a mounting end at a bottom of the housing configured to be mounted to the circuit board. The housing has first and second side walls extending between the top and the bottom. The housing has first and second end walls extending between the top and the bottom. The housing has a card slot open at the top for receiving the plug connector with the mating ends of the contacts being exposed in the card slot for mating electrical connection with the plug connector. The housing has a contact assembly cavity open at the bottom for receiving the contact assembly.

In another embodiment, a receptacle connector configured to mate with a plug connector is provided including a contact assembly having a dielectric carrier holding contacts having mating ends configured for electrical connection with the plug connector, terminating ends configured for electrical connection with a circuit board, and intermediate sections between the mating ends and the terminating ends passing through the dielectric carrier. The receptacle connector includes a housing holding the contact assembly having a mating end at a top of the housing configured to mate with the plug connector and a mounting end at a bottom of the housing configured to be mounted to the circuit board. The housing has first and second side walls extending between the top and the bottom and first and second end walls extending between the top and the bottom. The housing has a card slot open at the top for receiving the plug connector with the mating ends of the contacts being exposed in the card slot for mating electrical connection with the plug connector. The housing has a contact assembly cavity open at the bottom for receiving the contact assembly. The housing has positioning ribs extending from the first and second side walls into the contact assembly cavity to position the contact assembly within the contact assembly cavity.

In a further embodiment, a receptacle connector configured to mate with a plug connector is provided including a contact assembly having a dielectric carrier holding contacts having mating ends configured for electrical connection with the plug connector, terminating ends configured for electrical connection with a circuit board, and intermediate sections between the mating ends and the terminating ends passing through the dielectric carrier. The receptacle connector includes a housing holding the contact assembly having a mating end at a top of the housing configured to mate with the plug connector and a mounting end at a bottom of the housing configured to be mounted to the circuit board. The housing has first and second side walls extending between the top and the bottom and first and second end walls extending between the top and the bottom. The housing has a card slot open at the top for receiving the plug connector with the mating ends of the contacts being exposed in the card slot for mating electrical connection with the plug connector. The housing has a contact assembly cavity open at the bottom for receiving the contact assembly. The housing has strengthening ribs extending across the contact assembly cavity to connect the first side wall to the second side walls at a location remote from the first end wall and remote from the second end wall.

DETAILED DESCRIPTION OF THE INVENTION

Figure 1:
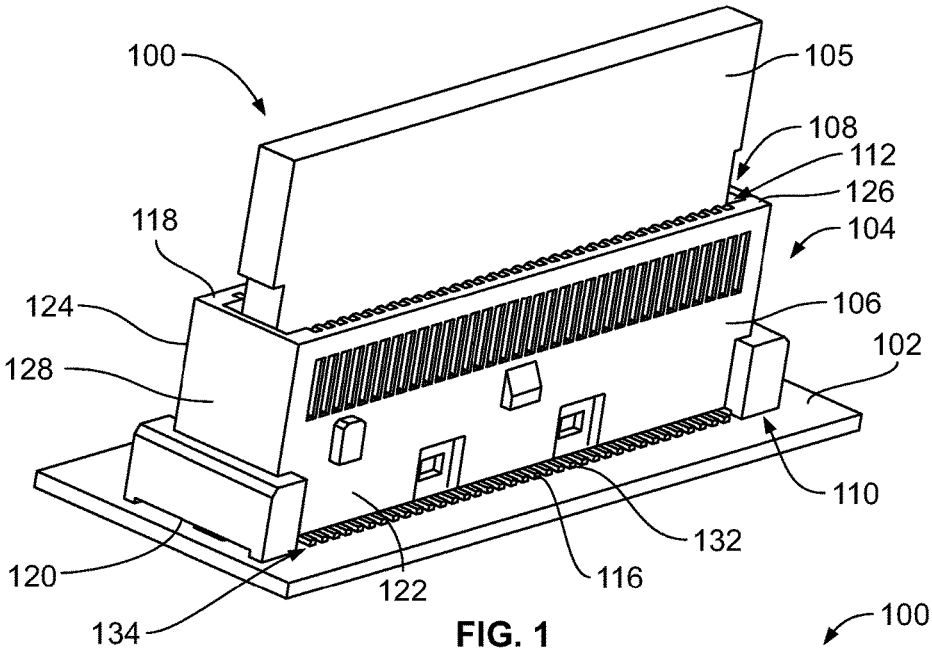
FIG. 1 is a top perspective view of an electrical connector system according to an exemplary embodiment showing a plug connector mated with a receptacle connector.
Figure 2:
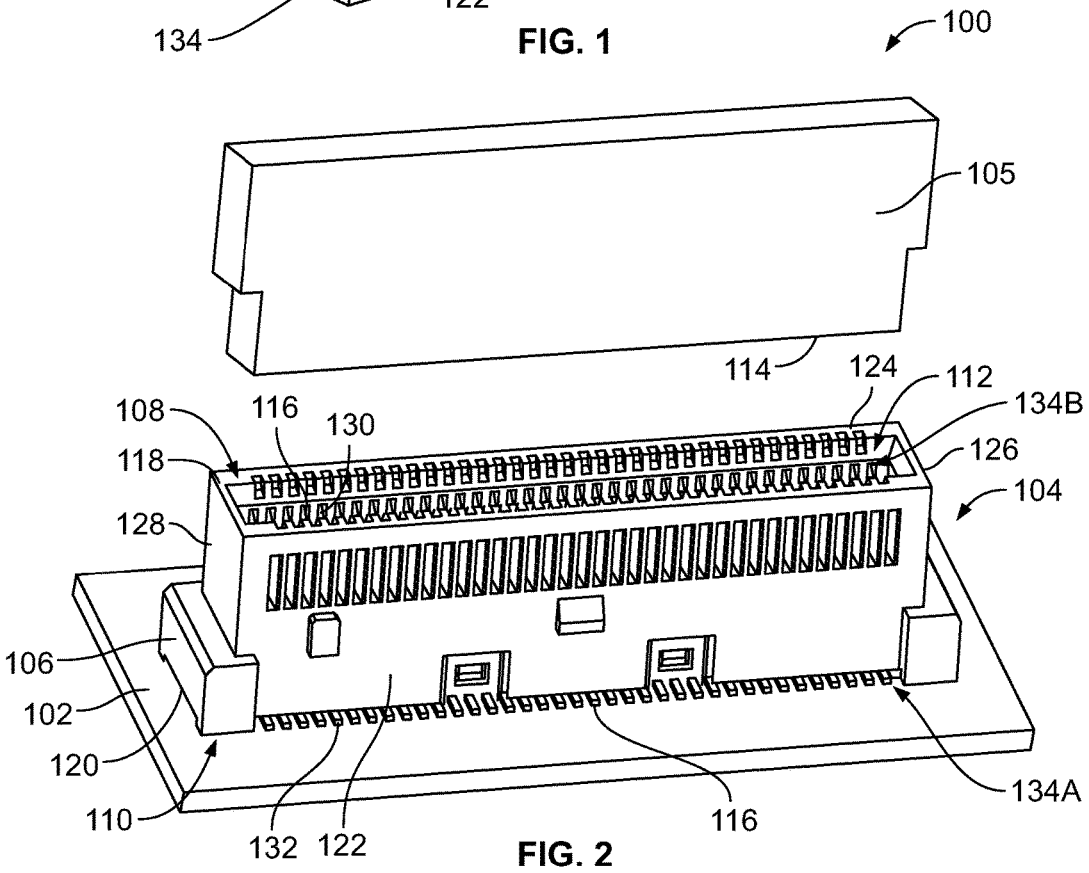
FIG. 2 is a top perspective view of the electrical connector system showing the plug connector poised for mating with the receptacle connector.

FIG. 1 is a top perspective view of an electrical connector system 100 according to an exemplary embodiment showing components in a mated state. FIG. 2 is a top perspective view of the electrical connector system 100 showing components in an unmated state. The electrical connector system 100 includes a circuit board 102 and a receptacle connector 104 mounted to the circuit board 102 configured to electrically connect to a plug connector 105 in order to provide an electrically conductive signal path between the circuit board 102 and the plug connector 105. The receptacle connector 104 may be a high speed connector that transmits data signals at speeds over 10 gigabits per second (Gbps), such as over 25 Gbps. The receptacle connector 104 may also be configured to transmit low speed data signals and/or power. The receptacle connector optionally may be an input-output (I/O) connector.

The receptacle connector 104 includes a housing 106 extending between a mating end 108 and a mounting end 110. The mounting end 110 is terminated to a top surface of the circuit board 102. The mating end 108 defines an interface for connecting to the plug connector 105. In the illustrated embodiment, the mating end 108 defines a socket or card slot 112 that is configured to receive the plug connector 105 therein. For example, a mating end of the plug connector 105 may be defined by a card edge 114 (FIG. 2) thereof. The card edge 114 may be an edge of a circuit card of the plug connector 105 having exposed conductors on one or both sides thereof configured to be plugged into the card slot 112. In other various embodiments, the card edge 114 may be an edge of a plug housing having exposed conductors on one or both sides thereof configured to be plugged into the card slot 112 or the card edge 114 may be another pluggable structure configured to be received in the card slot 112 for electrical connection with the receptacle connector 104.

The receptacle connector 104, in the illustrated embodiment, is a vertical board-mount connector such that the card slot 112 is configured to receive the plug connector 105 in a loading direction that is transverse to, such as perpendicular to, the top surface of the circuit board 102. In an alternative environment, the receptacle connector 104 may be a right angle style connector that is configured to receive the plug connector 105 in a loading direction that is parallel to the top surface. In another alternative embodiment, the receptacle connector 104 may be terminated to an electrical cable instead of to the circuit board 102. Optionally, the plug connector 105 may be a transceiver style connector that is configured to be terminated to one or more cables.

The housing 106 of the receptacle connector 104 holds a plurality of contacts 116 held at least partially within the housing 106. The housing 106 extends between a top 118 and an opposite bottom 120. The top 118 defines the mating end 108 of the connector 104 such that the card slot 112 extends into the connector 104 via the top 118. The bottom 120 may define at least a portion of the mounting end 110 of the connector 104. For example, the bottom 120 abuts or at least faces the top surface of the circuit board 102. The card slot 112 is defined by a first side wall 122, a second side wall 124, and first and second end walls 126, 128 that each extend between the side walls 122, 124. The side walls 122, 124 and end walls 126, 128 extend from the top 118 of the housing 106 towards the bottom 120. As used herein, relative or spatial terms such as "front," "rear," "first," "second,", "top", "bottom", "left," and "right" are only used to distinguish the referenced elements and do not necessarily require particular positions or orientations in the connector system 100 or the receptacle connector 104 relative to gravity or relative to the surrounding environment.

The contacts 116 of the receptacle connector 104 are configured to provide conductive signal paths through the receptacle connector 104. For example, each contact 116 includes a contact beam or spring beam defining a mating end 130 of the contact 116 configured to engage and electrically connect to a corresponding conductor (for example, trace or mating contact) of the plug connector 105 within the card slot 112 when the plug connector 105 is fully mated to the receptacle connector 104. The mating end 130 engages the mating conductor at a separable mating interface. The mating ends 130 are disposed within the card slot 112. The contacts 116 further include terminating ends 132 configured to be terminated to corresponding contact elements (not shown) of the circuit board 102 via thru-hole mounting to conductive vias, surface-mounting to conductive pads, and/or the like. In the illustrated embodiment, the terminating ends 132 of the contacts 116 are surface-mounted to pads on the top surface of the circuit board 102 and may be soldered to the pads on the circuit board 102.

In an embodiment, the contacts 116 are organized in at least one contact array 134. The contacts 116 in a respective array 134 are arranged side-by-side in a row. In the illustrated embodiment, the contacts 116 are organized in two arrays 134. The only portions of the contacts 116 in a first contact array 134A of the two arrays 134 that are visible in FIG. 2 are the mating ends 130, while the only portions of the contacts 116 in a second contact array 134B of the two arrays 134 that are visible are the terminating ends 132. The mating ends 130 of the contacts 116 in the first array 134A extend at least partially into the card slot 112 from the first side wall 122, and the mating ends 130 of the contacts 116 of the second array 134B extend at least partially into the card slot 112 from the second side wall 124. Thus, the mating ends 130 of the first array 134A of contacts 116 are configured to engage one side of the card edge 114 of the plug connector 105, while the mating ends 130 of the second array 134B of contacts 116 are configured to engage the opposite side of the card edge 114. The mating ends 130 may be configured to deflect towards and/or into the respective side walls 122, 124 from which the mating ends 130 extend in order to exert a biased retention force on the plug connector 105 to retain mechanical and electrical contact with the corresponding mating conductors. The card edge 114 of the plug connector 105 may be generally centered within the card slot 112 to balance the mating forces of the contacts 116. In an exemplary embodiment, the housing 106 includes alignment features to ensure that the plug connector 105 is generally centered within the card slot 112, which may reduce over-travel, and thus damage, to the contacts 116.

Figure 3:
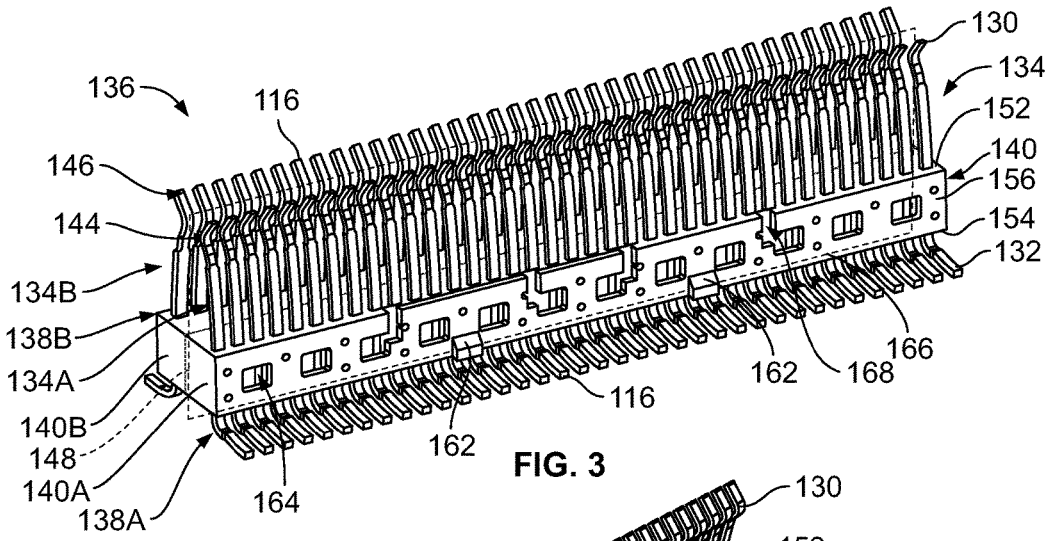
FIG. 3 is a perspective view of a contact assembly for the receptacle connector according to an exemplary embodiment.
Figure 4:
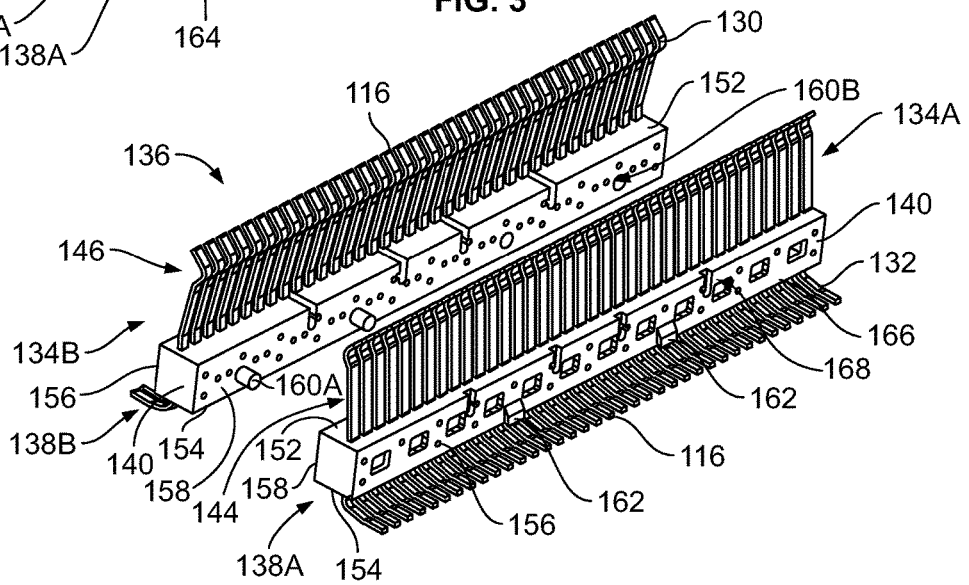
FIG. 4 is a perspective view of the contact assembly in an unassembled state.
Figure 5:
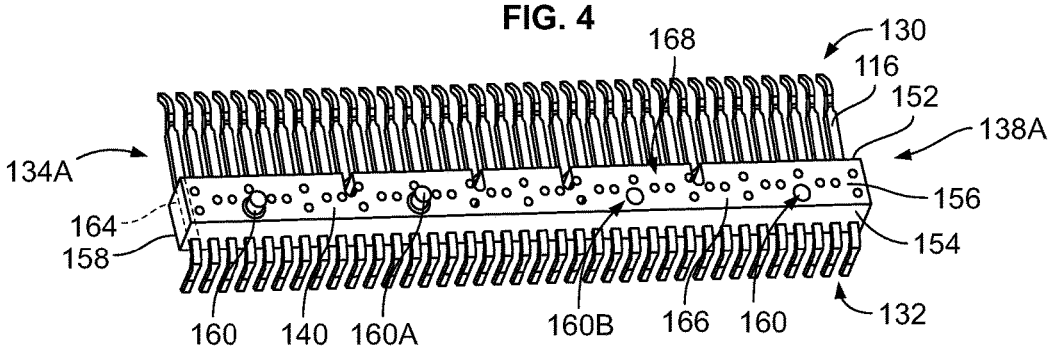
FIG. 5 is a perspective view of a portion of the contact assembly.

FIG. 3 is a perspective view of a contact assembly 136 for the receptacle connector 104 (shown in FIG. 1) according to an exemplary embodiment. FIG. 4 is a perspective view of the contact assembly 136 in an unassembled state. FIG. 5 is a perspective view of a portion of the contact assembly 136. In the illustrated embodiment, the contact assembly 136 includes first and second contact sub-assemblies 138A, 138B (FIG. 5 illustrates the first contact sub-assembly 138A), configured to be coupled together to form the contact assembly 136. Each contact sub-assembly 138 includes a dielectric carrier 140 (which may be identified as first and second dielectric carriers 140A and 140B, respectively) holding a plurality of the contacts 116. Optionally, as in the illustrated embodiment, the contact sub-assemblies 138A, 138B may be identical components inverted 180° and coupled together. In other embodiments, the contact sub-assemblies 138A, 138B may be similar to each other, but not identical, having some different features, such as securing features for securing the components together and/or to the housing 106 (shown in FIG. 1). Optionally, the contact sub-assemblies 138A, 138B may be hermaphroditic having hermaphroditic securing features (for example, posts and openings).

The contacts 116 are distributed in the arrays 134A, 134B. For example, the first array 134A is provided in the first contact sub-assembly 138A and the second array 134B is provided in the second contact sub-assembly 138B. The mating ends 130 of the contacts 116 in the first array 134A are arranged side-by-side in a first row 144 (FIG. 3), and the mating ends 130 of the contacts 116 in the second array 134B are arranged side-by-side in a second row 146 (FIG. 3). The first and second rows 144, 146 extend parallel to each other on opposite sides of a central plane 148 of the contact assembly 136 (the central plane 148 is shown oriented vertically and extending longitudinally through the contact assembly 136).

Each contact 116 extends continuously between the terminating end 132 and the mating end 130. Adjacent contacts 116 in the same array 134 may extend parallel to one another. The contacts 116 are composed of an electrically conductive material, such as one or more metals. The contacts 116 may be stamped and formed into shape from a flat sheet of metal. In an embodiment, at least some of the contacts 116 of the receptacle connector 104 are used to convey high speed data signals and some other contacts 116 are used as ground conductors to provide electrical shielding for the high speed signals and ground paths through the receptacle connector 104. Some of the contacts 116 may be used to provide low speed data signals, power, or the like, instead of high speed data signals.

The contacts 116 in each array 134 are evenly spaced-apart along the longitudinal axis of the contact assembly 136. In an embodiment, the contacts 116 are held in place by the dielectric carrier 140. The dielectric carrier 140 extends between a top 152 and a bottom 154. The dielectric carrier 140 has a front 156 and a rear 158 between the top 152 and the bottom 154. The rears 158 of the dielectric carriers 140 face and may abut against each other when the contact assembly 136 is assembled.

The rear 158 of each dielectric carrier 140 may include one or more securing features 160 for securing the dielectric carriers 140 together when the contact assembly 136 is assembled. The securing features 160 may interact with each other to secure the contact sub-assemblies 138 together. For example, the securing features 160 may be any combination of posts, openings, latches, catches, clips, fasteners or other types of securing features. In the illustrated embodiment, the securing features include posts 160A and openings 160B configured to receive the posts 160A of the other dielectric carrier 140. The posts 160A may be held in corresponding openings 160B by an interference or friction fit to secure the dielectric carriers 140 together. In the illustrated embodiment, the dielectric carriers 140 include two posts 160A at one end and two openings 160B at the other end thereof; however, any number and/or layout of posts 160A and openings 160B may be used in alternative embodiments. The openings 160B may be hexagonal shaped in some embodiments. In other alternative embodiments, rather than having two dielectric carriers 140, the contact assembly 136 may include a single dielectric carrier 140 holding either a single array 134 or multiple arrays 134.

The fronts 156 of the dielectric carriers 140 may face in opposite directions and may engage the housing 106. The front 156 of either or both dielectric carriers 140 may include one or more securing features 162 for securing the contact assembly 136 to the housing 106. The securing features 162 may interact with corresponding securing features of the housing 106 to secure the contact assembly 136 to the housing 106. For example, the securing features 162 may be any combination of clips, latches, catches, protrusions, openings or other types of securing features. In the illustrated embodiment, the securing features 162 are ramp-shaped catches used to interact with corresponding latches on the housing 106.

The contacts 116 extend through the dielectric carrier 140 such that the mating ends 130 protrude from the top 152 and terminating ends 132 protrude from the bottom 154 with the dielectric carrier 140 engaging and holding an intermediate section 164 of the contacts 116 to retain the relative positioning and orientations of the contacts 116.

The dielectric carrier 140 is formed of a dielectric material, such as a plastic or one or more other polymers. Optionally, the dielectric carrier 140 may be overmolded around the contacts 116. For example, the dielectric carrier 140 may include an overmolded body 166 molded around the intermediate sections 164 of the contacts 116. The overmolded body 166 is formed in place around the contacts 116. The overmolded body 166 may be injection molded around the contacts 116, which may be held together as part of a leadframe prior to overmolding. Alternatively, the contacts 116 may be loaded or stitched into a pre-formed dielectric carrier 140.

In an exemplary embodiment, the dielectric carrier 140 includes channels 168 formed in the top 152. The channels 168 are formed between various contacts 116. The channels 168 are configured to receive a portion of the housing 106 when the contact assembly 136 is loaded into the housing 106. The overmolded body 166 may be secured to the portion of the housing 106 received in the channels 168 by an interference fit. For example, the overmolded body 166 may include crush ribs or other securing features in the channel 168 to secure the dielectric carrier 140 to the housing 106.

Figure 6:
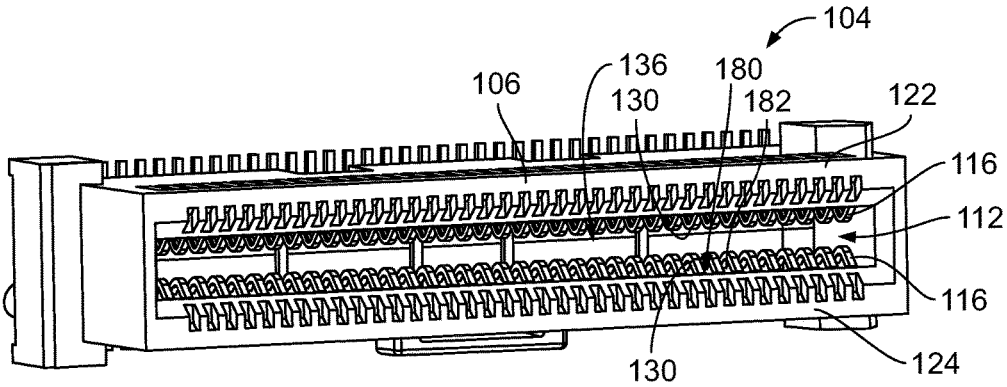
FIG. 6 is a top perspective view of the receptacle connector in accordance with an exemplary embodiment.

FIG. 6 is a top perspective view of the receptacle connector 104 in accordance with an exemplary embodiment. When assembled, the contact assembly 136 is received in the housing 106 such that the mating ends 130 of the contacts 116 are exposed within the card slot 112. In an exemplary embodiment, the housing 106 includes a plurality of contact channels 180 in the first and second side walls 122, 124. Each contact channel 180 receives a corresponding contact 116. The housing 106 includes separating walls 182 between the contact channels 180. The separating walls 182 hold the relative positions of the contacts 116. The separating walls 182 hold the contacts 116 in the contact channels 180. The separating walls 182 hold the contacts 116 parallel to each other and/or parallel to the mating direction with the plug connector 105 (shown in FIG. 1).

In an exemplary embodiment, the mating ends 130 are deflectable into the contact channels 180 when the plug connector 105 (FIG. 1) is loaded into the card slot 112. When the mating ends 130 are deflected, the contacts 116 are spring loaded against the plug connector 105 due to an internal biasing force exerted by the spring beams of the contacts 116. Spring loading the contacts 116 creates a mechanical and electrical connection with the plug connector 105. In an exemplary embodiment, the housing 106 may include features that center the plug connector 105 within the card slot 112 to prevent over-travel of any of the contacts 116 caused when the mating ends 130 are deflected beyond an elastic limit. Centering the plug connector 105 also balances the opposing spring forces of the two rows of contacts 116.

Figure 7:
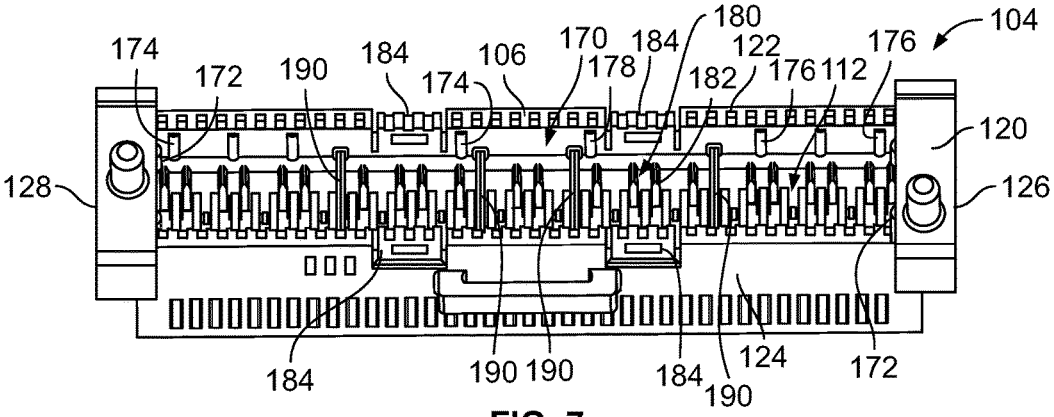
FIGS. 7 and 8 are bottom perspective views of a housing of the receptacle connector in accordance with an exemplary embodiment.
Figure 8:
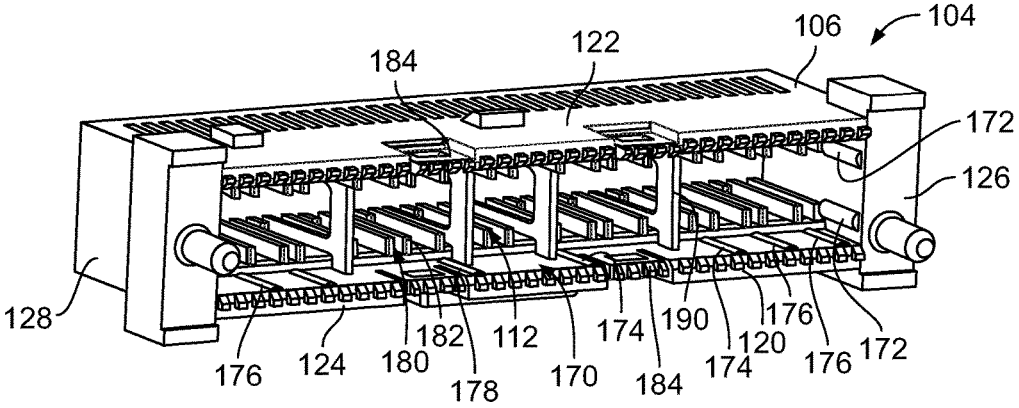

FIGS. 7 and 8 are bottom perspective views of the housing 106 of the receptacle connector 104 in accordance with an exemplary embodiment. The housing 106 includes a contact assembly cavity 170 at the bottom 120 that receives the contact assembly 136 (shown in FIG. 3). The contact assembly cavity 170 is positioned below the card slot 112. Optionally, the contact assembly cavity 170 may be wider than the card slot 112. The contact channels 180 and the separating walls 182 are shown in FIGS. 7 and 8.

The housing 106 includes end wall positioning ribs 172 on the end walls 126, 128. The end wall positioning ribs 172 longitudinally position and/or center the contact assembly 136 (FIGS. 3 and 6) within the contact assembly cavity 170. Optionally, the end wall positioning ribs 172 may be crush ribs configured to deform or crush when the contact assembly 136 is loaded into the contact assembly cavity 170. The contact assembly 136 may be held in the contact assembly cavity 170 by an interference fit between the end wall positioning ribs 172. For example, the end wall positioning ribs 172 may engage the dielectric carriers 140 with a holding force sufficient to retain the contact assembly 136 in the contact assembly cavity 170.

The housing 106 includes side wall positioning ribs 174 on the side walls 122, 124. The side wall positioning ribs 174 laterally position and/or center the contact assembly 136 within the contact assembly cavity 170. Optionally, the side wall positioning ribs 174 may be crush ribs configured to deform or crush when the contact assembly 136 is loaded into the contact assembly cavity 170. The contact assembly 136 may be held in the contact assembly cavity 170 by an interference fit between the side wall positioning ribs 174. For example, the side wall positioning ribs 174 may engage the dielectric carriers 140 with a holding force (for example, a force sufficient to retain the contact assembly 136 in the contact assembly cavity 170). Alternatively, rather than securing the contact assembly 136 in the contact assembly cavity 170, the side wall positioning ribs 174 may serve merely for alignment of the contact assembly 136 within the contact assembly cavity 170 rather than holding or securing the contact assembly 136 in the contact assembly cavity 170. For example, while the side wall positioning ribs 174 may engage one or both sides of the contact assembly 136, the side wall positioning ribs 174 may engage the contact assembly 136 with a non-holding force (for example, a force insufficient to retain the contact assembly 136 in the contact assembly cavity 170).

In an exemplary embodiment, the housing 106 includes different types of side wall positioning ribs 174. For example, the housing 106 includes primary positioning ribs 176 and secondary positioning ribs 178. The primary positioning ribs 176 are press-fit against the contact assembly 136 to hold the contact assembly 136 in the contact assembly cavity 170, and as such define press-fit ribs 176. The press-fit ribs 176 may be crush ribs configured to deform or crush when the contact assembly 136 is loaded into the contact assembly cavity 170. The press-fit ribs 176 impart a holding force on the contact assembly 136 sufficient to retain the contact assembly 136 in the contact assembly cavity 170 (either alone or cumulatively as a set with other press-fit ribs 176 and/or the end wall positioning ribs 172). The secondary positioning ribs 178 are used for aligning the contact assembly 136 in the contact assembly cavity 170 without being press-fit against the contact assembly 136, and may be referred to hereinafter as alignment-fit ribs 178. The alignment-fit ribs 178 have less holding force than the press-fit ribs 176. The secondary positioning ribs 178 may engage the contact assembly 136, such as to control the alignment or position of the contact assembly 136 (for example, to hold the contact assembly 136 a spaced distance from the corresponding side wall 122, 124); however, each of the secondary positioning ribs 178 do not necessarily need to engage the contact assembly 136 as the contact assembly 136, the housing 106 and/or the secondary positioning ribs 178 may be designed with a tolerance so the components do not bind when assembled.

In an exemplary embodiment, the press-fit ribs 176 are provided closer to the end walls 126, 128 while the alignment-fit ribs 178 are provided closer to the longitudinal center of the housing 106. For example, in the illustrated embodiment, three press-fit ribs 176 are provided at each end portion (for example, the outer thirds) of each side wall 122, 124 near the corresponding end walls 126, 128 while two alignment-fit ribs 178 are provided at the center portions (for example, the central third) of each side wall 122, 124. Because the side walls 122, 124 are more rigidly held relative to each other near the end walls 126, 128 due to the support provided by the end walls 126, 128, the end portions of the side walls 122, 124 are more apt to hold the contact assembly 136. Thus, the primary or press-fit ribs 176 are located along the end portions of the side walls 122, 124 near the end walls 126, 128. In contrast, because the side walls 122, 124 are unsupported, and thus more flimsy near the center portion of the side walls 122, 124, the secondary or alignment-fit ribs 178 are provided at the center portions of the side walls 122, 124. Additionally, if press-fit ribs 176 were provided at the center portions of the side walls 122, 124, the center portions may tend to bow or flex outward, which may cause improper positioning of the contact assembly 136 within the housing 106 and/or improper positioning of the housing 106 on the circuit board 102, which may lead to misalignment of the contacts 116 with the pads on the circuit board 102. However, in alternative embodiments, the side walls 122, 124 may be made more robust, such as thicker, to withstand the holding forces of press-fit ribs 176 in the center portions of the side walls 122, 124, and/or strengthening ribs may be provided across the contact assembly cavity 170 to provide additional support, as described in further detail below.

The housing 106 includes securing features 184 that interact with the securing features 162 (shown in FIG. 3) of the contact assembly 136 to hold the contact assembly 136 in the contact assembly cavity 170. In the illustrated embodiment, the securing features 184 are latches used to engage the catches defining the securing features 162; however, other types of securing features 184 may be provided in alternative embodiments. The securing features 184 are provided on both side walls 122, 124; however, only one of the side walls 122, 124 may have securing features 184 in alternative embodiments. In other alternative embodiments, the end walls 126, 128 may include the securing features 184.

In an exemplary embodiment, the housing 106 includes strengthening ribs 190 extending across the contact assembly cavity 170 to connect the first side wall 122 to the second side wall 124 at locations remote from the first end wall 126 and remote from the second end wall 128. The strengthening ribs 190 may be provided at or near the center portions of the side walls 122, 124. The strengthening ribs 190 tie the first and second side walls 122, 124 together to resist bowing outward of the first and second side walls 122, 124. The strengthening ribs 190 brace the side walls 122, 124 at multiple locations to resist warping, bowing or flexing of the side walls 122, 124, which may keep the side walls 122, 124 straighter in the longitudinal direction, particularly for longer housings 106. Providing the strengthening ribs 190 may allow the housing 106 to be manufactured with a less expensive material while still achieving the same amount of rigidity.

Figure 9:
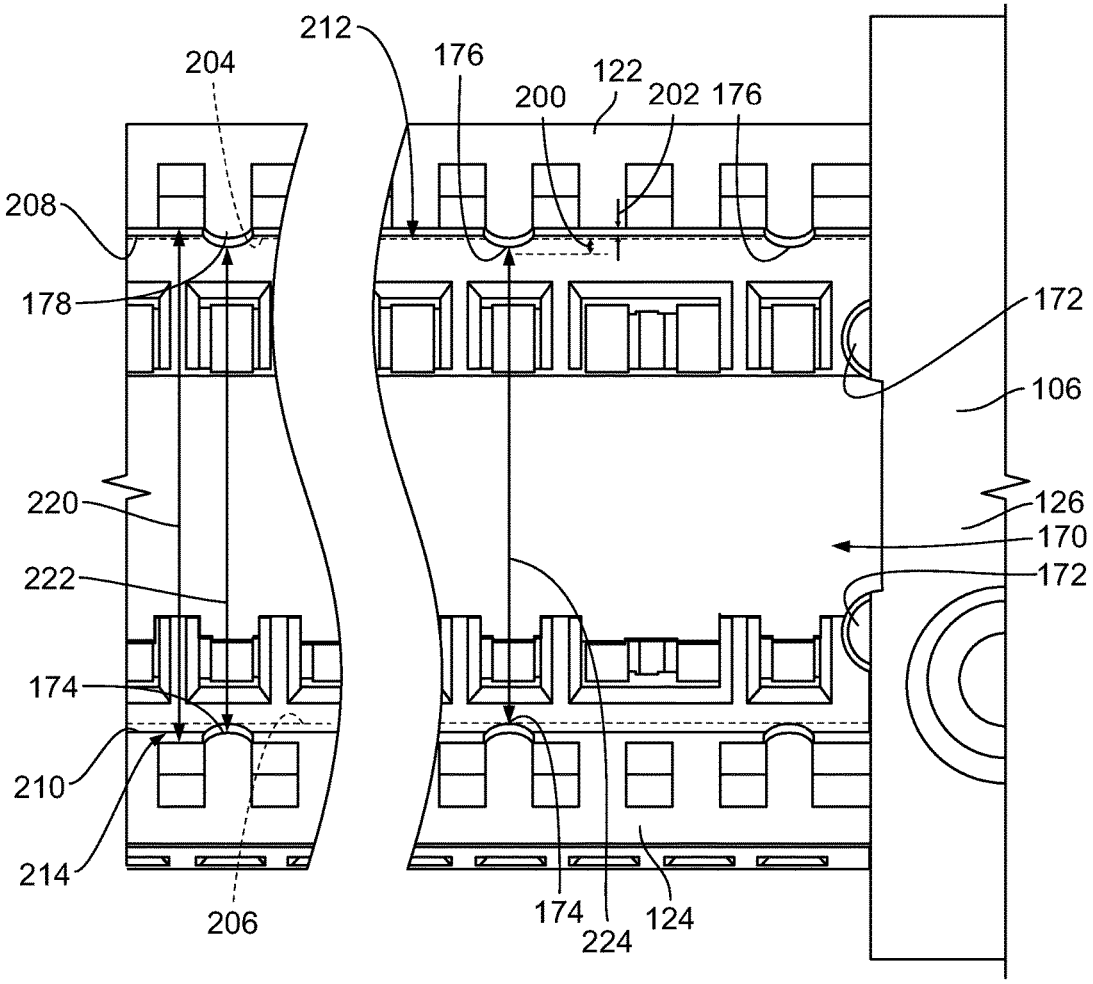
FIG. 9 is a bottom view of a portion of the housing in accordance with an exemplary embodiment.

FIG. 9 is a bottom view of a portion of the housing 106 in accordance with an exemplary embodiment. The end wall positioning ribs 172 and the side wall positioning ribs 174 are shown in FIG. 9, including both press-fit ribs 176 and alignment-fit ribs 178. The positioning ribs 176, 178 extend from both the first and second side walls 122, 124 into the contact assembly cavity 170 to position the contact assembly 136 (FIG. 3) within the contact assembly cavity 170. As noted above, both types of positioning ribs 176, 178 are used to position the contact assembly 136 in the contact assembly cavity 170; however, the press-fit positioning ribs 176 more tightly engage the contact assembly 136 than the alignment-fit positioning ribs 178. For example, the press-fit positioning ribs 176 are used for both aligning and securing the contact assembly 136 while the alignment-fit positioning ribs 178 are used for alignment of the contact assembly 136, such as centering the contact assembly 136, without securing the contact assembly 136 in the cavity 170. In the illustrated embodiment, the primary or press-fit ribs 176 are located closer to the end wall 126 outside of the secondary or alignment-fit ribs 178. For example, the press-fit ribs 176 are positioned between the alignment-fit ribs 178 and the end wall 126. In other various embodiments, the side wall positioning ribs 174 may only include the press-fit positioning ribs 176 or may only include the alignment-fit positioning ribs 178.

In an exemplary embodiment, the primary or press-fit ribs 176 extend from the housing 106 into the contact assembly cavity 170 a first depth 200 while the secondary or alignment-fit ribs 178 extend from the housing 106 into the contact assembly cavity 170 a second depth 202 less than the first depth 200. The alignment-fit ribs 178 on the first side wall 122 define a first alignment plane 204 and the alignment-fit ribs 178 on the second side wall 124 define a second alignment plane 206. The alignment planes 204, 206 are spaced-apart from interior surfaces 208, 210 of the side walls 122, 124 to define gaps 212, 214, respectively. The alignment-fit ribs 178 block the contact assembly 136 from entering the gaps 212, 214 ensuring that the contact assembly 136 does not drift too close to the first side wall 122 or the second side wall 124, which could overstress the contacts 116 by bending the contacts 116 beyond over-travel limits or elastically deforming the contacts 116. The press-fit ribs 176 on the first side wall 122 extend into the contact assembly cavity 170 beyond the first alignment plane 204. The press-fit ribs 176 on the second side wall 124 extend into the contact assembly cavity 170 beyond the second alignment plane 206.

In an exemplary embodiment, the contact assembly cavity 170 has a first width 220 defined between the side walls 122, 124. A second width 222 is defined between the alignment planes 204, 206 and is narrower than the first width 220. Optionally, the alignment-fit ribs 178 may be aligned with each other on opposite sides of the contact assembly cavity 170 and thus the second width 222 is the width between the outer edges of the alignment-fit ribs 178. However, in other embodiments, the alignment-fit ribs 178 may be staggered or off-set from each other across the contact assembly cavity 170. A third width 224 is defined between the press-fit ribs 176 and is narrower than the second width 222. Optionally, the press-fit ribs 176 may be aligned with each other on opposite sides of the contact assembly cavity 170 and thus the third width 224 is the width between the outer edges of the press-fit ribs 176. However, in other embodiments, the press-fit ribs 176 may be staggered or off-set from each other across the contact assembly cavity 170, in which case the third width 224 is the width between planes defined by the outer edges of the press-fit ribs 176.

Figure 10:
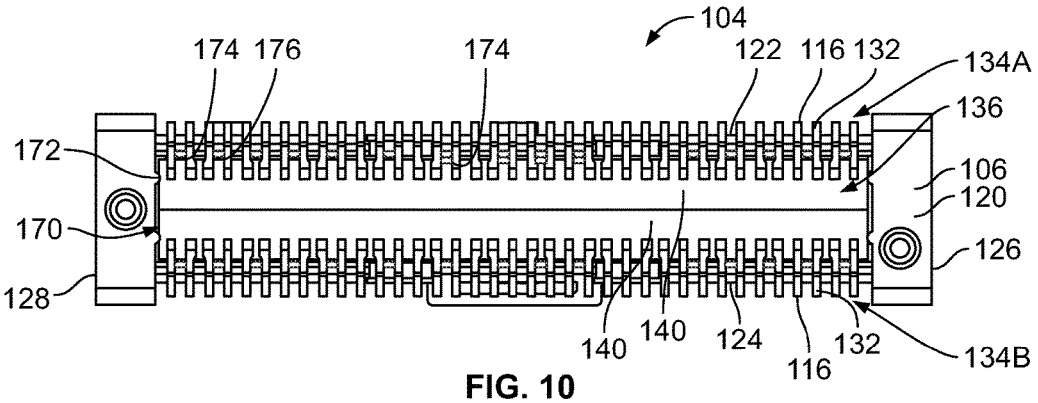
FIG. 10 is a bottom view of the receptacle connector showing the contact assembly loaded in a contact assembly cavity at a bottom of the housing.

FIG. 10 is a bottom view of the receptacle connector 104 showing the contact assembly 136 loaded in the contact assembly cavity 170 at the bottom 120 of the housing 106. The contact assembly 136 is loaded into the contact assembly cavity 170 until the terminating ends 132 of the contacts 116 are at the bottom 120. The terminating ends 132 of the first and second contact arrays 134A, 134B extend away from each other in opposite directions. Optionally, the terminating ends 132 may be positioned below the side walls 122, 124.

The end wall positioning ribs 172 on the end walls 126, 128 longitudinally position and/or center the contact assembly 136 within the contact assembly cavity 170. The contact assembly 136 may be held in the contact assembly cavity 170 by an interference fit with the end wall positioning ribs 172 at opposite ends of the housing 106. In the illustrated embodiment, the end wall positioning ribs 172 engage the dielectric carriers 140.

The side wall positioning ribs 174 on the side walls 122, 124 laterally position and/or center the contact assembly 136 within the contact assembly cavity 170. In the illustrated embodiment, the side wall positioning ribs 174 engage the dielectric carriers 140. The contact assembly 136 may be held in the contact assembly cavity 170 by an interference fit with the press-fit ribs 176 at opposite sides of the housing 106.

Figure 11:
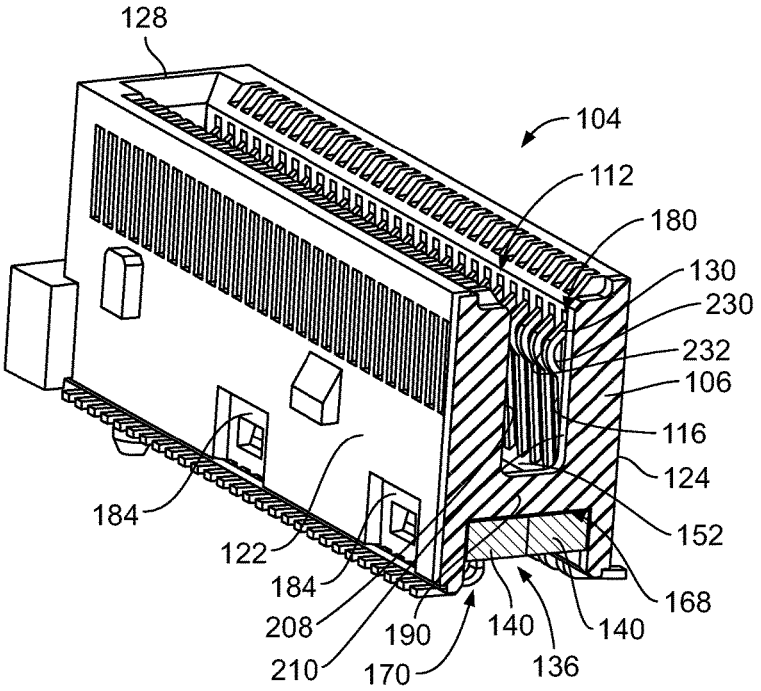
FIG. 11 is a partial sectional view of the receptacle connector in accordance with an exemplary embodiment.

FIG. 11 is a partial sectional view of the receptacle connector 104 in accordance with an exemplary embodiment. FIG. 11 illustrates one of the strengthening ribs 190 between the side walls 122, 124. The strengthening rib 190 extends across the contact assembly cavity 170 to connect the first side wall 122 to the second side wall 124 at a location remote from the second end wall 128 and remote from the first end wall (not shown). The strengthening rib 190 ties the first and second side walls 122, 124 together to resist bowing outward of the first and second side walls 122, 124.

In the illustrated embodiment, the strengthening rib 190 is positioned proximate to the securing features 184 of the housing 106 to ensure that the side walls 122, 124 do not bow outward in the area of the securing features 184, which could otherwise cause the contact assembly 136 to disengage from the securing features 184. The strengthening rib 190 is received in the channels 168 in the tops 152 of the dielectric carriers 140.

In an exemplary embodiment, the strengthening rib 190 extends above the contact assembly cavity 170 into the card slot 112. The strengthening rib 190 may extend above the tops 152 of the dielectric carriers 140. The strengthening rib 190 extends across the card slot 112 above the contact assembly cavity 170. The plug connector 105 (shown in FIG. 1) may include a notch or groove to receive the top part of the strengthening rib 190. Optionally, the strengthening rib 190 may serve to position the plug connector 105 in the card slot 112. For example, the plug connector 105 may bottom out against the top of the strengthening rib 190 to define the fully mated position.

As shown in FIG. 11, the contacts 116 include interface bumps 230 at the mating ends 130 configured to interface with the plug connector 105. The interface bumps 230 are convex shaped bends in the contacts 116 at the mating ends 130. The interface bumps 230 extend beyond the interior surfaces 208, 210 into the card slot 112 to interface with the plug connector 105. The interface bumps 230 define mating interfaces 232 configured to engage the plug connector 105. Distal ends of the contacts 116 (for example, above the mating interfaces 232) are bent back into the contact channels 180 to prevent stubbing with the plug connector 105 when the plug connector 105 is loaded in the card slot 112. The mating ends 130 may be deflected outward, such as into the contact channels 180, when the plug connector 105 is loaded into the card slot 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A receptacle connector configured to mate with a plug connector, the receptacle connector comprising:

a contact assembly having a first contact sub-assembly and a second contact sub-assembly coupled to the first contact sub-assembly, the first and second contact sub-assemblies having corresponding first and second dielectric carriers, the first and second contact sub-assemblies having contacts held by the first and second dielectric carriers, respectively, the contacts being arranged in first and second contact arrays aligned in corresponding first and second rows, the contacts having mating ends configured for electrical connection with the plug connector, the contacts having terminating ends configured for electrical connection with a circuit board, the contacts having intermediate sections between the mating ends and the terminating ends, the intermediate sections being overmolded by an overmolded body forming the corresponding first and second dielectric carriers; and a housing holding the contact assembly, the housing having a mating end at a top of the housing configured to mate with the plug connector and a mounting end at a bottom of the housing configured to be mounted to the circuit board, the housing having first and second side walls extending between the top and the bottom, the housing having first and second end walls extending between the top and the bottom, the housing having a card slot open at the top for receiving the plug connector with the mating ends of the contacts being exposed in the card slot for making electrical connection with the plug connector, the housing including a contact assembly cavity open at the bottom for receiving the contact assembly such that the first and second rows of contacts are parallel to the first and second side walls, the housing having positioning ribs extending from the first and second side walls into the contact assembly cavity periodically along the first and second side walls between the first and second end walls including remote from the first and second end walls to engage sides of the first and second dielectric carriers to control a side-to-side position of the contact assembly within the contact assembly cavity.

2. The receptacle connector of claim 1, wherein the first and second contact sub-assemblies are identical and inverted 180° relative to each other and coupled together to form the contact assembly.

3. The receptacle connector of claim 1, wherein the contact assembly includes at least one securing feature on at least one of the first and second dielectric carriers, the housing including at least one securing feature on at least one of the first and second side walls interacting with the at least one securing feature of the contact assembly to secure the contact assembly in the contact assembly cavity.

4. The receptacle connector of claim 1, wherein the positioning ribs extending from the first and second side walls to distal ends engaging the contact assembly to position the contact assembly within the contact assembly cavity.

5. The receptacle connector of claim 1, wherein the positioning ribs comprise primary positioning ribs and secondary positioning ribs, the primary positioning ribs being press-fit against the contact assembly to hold the contact assembly in the contact assembly cavity, the secondary positioning ribs aligning the contact assembly in the contact assembly cavity without being press-fit against the contact assembly.

6. The receptacle connector of claim 1, wherein the housing includes a strengthening rib extending across the contact assembly cavity to connect the first side wall to the second side wall at a location remote from the first end wall and remote from the second end wall.

7. The receptacle connector of claim 6, wherein the strengthening rib ties the first and second side walls together to resist bowing outward of the first and second side walls.

8. A receptacle connector configured to mate with a plug connector, the receptacle connector comprising:

a contact assembly having a dielectric carrier holding contacts, the contacts having mating ends configured for electrical connection with the plug connector, the contacts having terminating ends configured for electrical connection with a circuit board, the contacts having intermediate sections between the mating ends and the terminating ends, the intermediate sections passing through the dielectric carrier; and a housing holding the contact assembly, the housing having a mating end at a top of the housing configured to mate with the plug connector and a mounting end at a bottom of the housing configured to be mounted to the circuit board, the housing having first and second side walls extending between the top and the bottom, the housing having first and second end walls extending between the top and the bottom, the housing having a card slot open at the top for receiving the plug connector with the mating ends of the contacts being exposed in the card slot for making electrical connection with the plug connector, the housing including a contact assembly cavity open at the bottom for receiving the contact assembly;

wherein the housing includes primary positioning ribs and secondary positioning ribs extending from the first and second side walls into the contact assembly cavity to position the contact assembly within the contact assembly cavity, the primary positioning ribs being press-fit against the contact assembly to hold the contact assembly in the contact assembly cavity, the secondary positioning ribs aligning the contact assembly in the contact assembly cavity without being press-fit against the contact assembly.

9. The receptacle connector of claim 8, wherein the primary positioning ribs extend from the housing into the contact assembly cavity a first depth, the secondary positioning ribs extend from the housing into the contact assembly cavity a second depth less than the first depth.

10. The receptacle connector of claim 8, wherein the primary positioning ribs are located outside of the secondary positioning ribs between the secondary positioning ribs and the corresponding end wall.

11. The receptacle connector of claim 8, wherein the primary positioning ribs comprise press-fit ribs on both the first and second side walls and the secondary positioning ribs comprise alignment-fit ribs on both the first and second side walls, the press-fit ribs engaging the contact assembly and imparting a holding force against the contact assembly, the alignment fit ribs engaging the contact assembly and imparting a non-holding force against the contact assembly less than the holding force.

12. The receptacle connector of claim 11, wherein the alignment-fit ribs on the first side wall define a first alignment plane and the alignment-fit ribs on the second side wall define a second alignment plane, the press-fit ribs on the first side wall extend into the contact assembly cavity beyond the first alignment plane, the press-fit ribs on the second side wall extend into the contact assembly cavity beyond the second alignment plane.

13. The receptacle connector of claim 8, further comprising end wall positioning ribs extending from the first and second end walls into the contact assembly cavity to position the contact assembly within the contact assembly cavity.

14. The receptacle connector of claim 8, wherein the contact assembly includes a first contact sub-assembly and a second contact sub-assembly coupled to the first contact sub-assembly, the first and second contact sub-assemblies each having corresponding first and second dielectric carriers, the first and second contact sub-assemblies each having contacts held by the first and second dielectric carriers, respectively, the contacts being arranged in first and second contacts arrays aligned in corresponding first and second rows, the intermediate sections of the contacts being overmolded by an overmolded body forming the corresponding first and second dielectric carriers.

15. A receptacle connector configured to mate with a plug connector, the receptacle connector comprising:

a contact assembly having a dielectric carrier holding contacts, the contacts having mating ends configured for electrical connection with the plug connector, the contacts having terminating ends configured for electrical connection with a circuit board, the contacts having intermediate sections between the mating ends and the terminating ends, the intermediate sections passing through the dielectric carrier; and a housing holding the contact assembly, the housing having a mating end at a top of the housing configured to mate with the plug connector and a mounting end at a bottom of the housing configured to be mounted to the circuit board, the housing having first and second side walls extending between the top and the bottom, the housing having first and second end walls extending between the top and the bottom, the first and second side walls being significantly longer than the first and second end walls, the housing having a card slot open at the top for receiving the plug connector with the mating ends of the contacts being exposed in the card slot for making electrical connection with the plug connector, the housing including a contact assembly cavity open at the bottom for receiving the contact assembly;

wherein the housing includes strengthening ribs extending across the contact assembly cavity to connect the first side wall to the second side wall at a location remote from the first end wall and remote from the second end wall; and wherein the housing includes positioning ribs extending from the first and second side walls into the contact assembly cavity periodically along the first and second side walls between the first and second end walls including remote from the first and second end walls to engage sides of the first and second dielectric carriers to control a side-to-side position of the contact assembly within the contact assembly cavity.

16. The receptacle connector of claim 15, wherein the housing includes securing features for securing the contact assembly in the contact assembly cavity, the strengthening ribs positioned proximate to the securing features.

17. The receptacle connector of claim 15, wherein the strengthening ribs extend across the card slot above the contact assembly cavity.

18. The receptacle connector of claim 15, wherein the dielectric carrier includes channels in a top of the dielectric carrier, the channels receiving corresponding strengthening ribs.

19. The receptacle connector of claim 15, wherein the positioning ribs comprise press-fit ribs on both the first and second side walls and alignment-fit ribs on both the first and second side walls, the press-fit ribs engaging the contact assembly and imparting a holding force against the contact assembly, the alignment fit ribs engaging the contact assembly and imparting a non-holding force against the contact assembly less than the holding force.

20. The receptacle connector of claim 1, wherein the positioning ribs comprise press-fit ribs on both the first and second side walls and alignment-fit ribs on both the first and second side walls, the press-fit ribs engaging the contact assembly and imparting a holding force against the contact assembly, the alignment fit ribs engaging the contact assembly and imparting a non-holding force against the contact assembly less than the holding force.

* * * * *